US010816288B1

(12) United States Patent
Oglesby

(10) Patent No.: US 10,816,288 B1
(45) Date of Patent: Oct. 27, 2020

(54) ADJUSTABLE GAS BLOCK ASSEMBLY

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 16/511,644

(22) Filed: Jul. 15, 2019

Related U.S. Application Data

(60) Provisional application No. 62/697,566, filed on Jul. 13, 2018.

(51) Int. Cl.
*F41A 5/28* (2006.01)

(52) U.S. Cl.
CPC ..... *F41A 5/28* (2013.01)

(58) Field of Classification Search
CPC ..... F41A 5/24; F41A 5/26; F41A 5/28
USPC ..... 89/193
See application file for complete search history.

(56) References Cited

U.S. PATENT DOCUMENTS 4,244,273 A * 1/1981 Langendorfer, Jr. ..... F41A 5/28 89/193
5,272,956 A * 12/1993 Hudson ..... F41A 5/28 42/72
7,469,624 B1 * 12/2008 Adams ..... F41A 5/26 89/191.01
8,109,196 B1 * 2/2012 Spence ..... F41A 5/24 89/193
9,273,916 B1 * 3/2016 Russo ..... F41A 5/26
2010/0275770 A1 * 11/2010 Noveske ..... F41A 5/28 89/193

* cited by examiner

*Primary Examiner* — Bret Hayes
(74) *Attorney, Agent, or Firm* — Shaddock Law Group, PC

(57) ABSTRACT

An adjustable gas block, including at least some of a body portion with a barrel borehole extending therethrough; a gas block extension portion extending from the body portion; a gas tube borehole extending through the gas block portion and into at least a portion of the gas block extension portion; a gas block gas port in fluid communication between the barrel borehole and the gas tube borehole; a vent aperture extending through the gas tube borehole, providing fluid communication between the gas tube borehole and an exterior of the gas block extension portion; and a vent cap rotatably positionable relative to the gas block extension portion so as to be positioned between a closed position, wherein the vent cap obstructs, blocks, or occludes the vent aperture, and an open position, wherein the vent cap does not obscure, block, or occlude the vent aperture.

17 Claims, 16 Drawing Sheets

ADJUSTABLE GAS BLOCK ASSEMBLY

CROSS-REFERENCE TO RELATED APPLICATIONS

This patent application claims the benefit of U.S. Patent Application Ser. No. 62/697,566, filed Jul. 13, 2018, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an adjustable gas block assembly for a firearm.

2. Description of Related Art

A number of firearms operate based on a gas blowback system. One such firearm is the M-16, M-4, and AR-15 family of firearms.

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier and the bolt and drives the bolt carrier rearward.

The buffer, which is pushing on the rear of the bolt carrier group, is forced rearward by the bolt carrier group compressing the recoil spring. During this rearward movement, a cam track in the upper portion of the bolt carrier acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the rear of the buffer tube), the compressed recoil spring expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, typical gas blocks and gas systems are not capable of bleeding off extra gas pressure before the propellant gas pressure actuates the bolt carrier and causes excessive recoil.

The disadvantages and shortcomings of the prior art are overcome by the features and elements of the adjustable gas block of the present disclosure. The advantages of the present disclosure are optionally attained by providing, in an exemplary, nonlimiting embodiment, an adjustable gas block that includes at least some of a body portion having a longitudinal axis; a barrel borehole extending through the body portion, along the longitudinal axis of the body portion, wherein the barrel borehole is adapted to receive at least a portion of a barrel therethrough; a gas block extension portion extending from the body portion; a gas tube borehole extending through the gas block portion and into at least a portion of the gas block extension portion; a gas block gas port in fluid communication between the barrel borehole and the gas tube borehole; a vent aperture extending through at least a portion of the gas tube borehole, wherein the vent aperture provides fluid communication between the gas tube borehole and an exterior of the gas block extension portion; and a vent cap positioned relative to the gas block extension portion, wherein the vent cap is rotatably positionable relative to the gas block extension portion so as to be positioned between a closed position, wherein the vent cap obstructs, blocks, or occludes the vent aperture, and an open position, wherein the vent cap does not obscure, block, or occlude the vent aperture.

In certain exemplary, nonlimiting embodiments of the present disclosure, the adjustable gas block assembly comprises a gas block having a body portion extending along a longitudinal axis; a barrel borehole extending through the body portion, along the longitudinal axis of the body portion, wherein the barrel borehole is adapted to receive at least a portion of a barrel therethrough; a gas block extension portion extending from the body portion; a gas tube borehole extending through the gas block portion and into at least a portion of the gas block extension portion; a gas block gas port in fluid communication between the barrel borehole and the gas tube borehole; a vent aperture extending through at least a portion of the gas tube borehole, wherein the vent aperture provides fluid communication between the gas tube borehole and an exterior of the gas block extension portion; a vent cap positioned relative to the gas block extension portion, wherein the vent cap is rotatably positioned relative to the gas block extension portion so as to be rotated between a closed position, wherein the vent cap obstructs, blocks, or occludes the vent aperture, and an open position, wherein the vent cap does not obscure, block, or occlude the vent aperture.

In certain exemplary, nonlimiting embodiments of the present disclosure, the vent cap is spring biased relative to the gas block extension portion.

In certain exemplary, nonlimiting embodiments of the present disclosure, the vent cap is spring biased relative to the gas block extension portion by interaction of a portion of a tension element and a spline portion of the gas block extension portion.

In certain exemplary, nonlimiting embodiments of the present disclosure, at least a portion of the gas tube borehole, extending from a first end of the gas block portion includes an internally threaded portion and wherein at least a portion of the gas tube includes an externally threaded portion, such that the gas tube is able to be at least partially threadedly attached or coupled to the gas tube borehole, via interaction of the externally threaded portion of the gas tube and the internally threaded portion of the gas tube borehole.

In certain exemplary, nonlimiting embodiments of the present disclosure, the vent aperture comprises a substantially elongate, constant width slot.

In certain exemplary, nonlimiting embodiments of the present disclosure, the vent aperture comprises a plurality of apertures.

In certain exemplary, nonlimiting embodiments of the present disclosure, if the vent cap is positioned between the closed position and the open position, the vent cap partially obstructs, blocks, or occludes the vent aperture.

In certain exemplary, nonlimiting embodiments of the present disclosure, the adjustable gas block assembly comprises a gas block having a body portion; a barrel borehole extending through the body portion; a gas block extension portion extending from the body portion; a gas tube borehole extending through the gas block portion and into at least a portion of the gas block extension portion; a gas block gas port in fluid communication between the barrel borehole and the gas tube borehole; a vent aperture extending through at least a portion of the gas tube borehole, wherein the vent aperture provides fluid communication between the gas tube borehole and an exterior of the gas block extension portion; a vent cap positioned relative to the gas block extension portion, wherein the vent cap is rotatably positioned relative to the gas block extension portion so as to be rotated between a closed position, wherein the vent cap obstructs, blocks, or occludes the vent aperture, and an open position, wherein the vent cap does not obscure, block, or occlude the vent aperture.

In certain exemplary, nonlimiting embodiments of the present disclosure, the adjustable gas block assembly comprises a gas block; a barrel borehole extending through the gas block; a gas block extension portion extending from the gas block; a gas tube borehole extending through the gas block portion and into at least a portion of the gas block extension portion; a gas block gas port in fluid communication between the barrel borehole and the gas tube borehole; a vent aperture extending through at least a portion of the gas tube borehole, wherein the vent aperture provides fluid communication between the gas tube borehole and an exterior of the gas block extension portion; a vent cap positioned relative to the gas block extension portion, wherein the vent cap is rotatably positioned relative to the gas block extension portion so as to be rotated between an open position, wherein the vent cap does not obscure, block, or occlude the vent aperture and a closed position, wherein the vent cap obstructs, blocks, or occludes the vent aperture.

Accordingly, the presently disclosed systems, methods, and/or apparatuses provide an adjustable gas block that allows a user to adjust the amount of propellant gas that is returned to the firearm for cycling the bolt during a firing cycle.

The presently disclosed systems, methods, and/or apparatuses optionally and separately provide an adjustable gas block that may optionally provide increased bolt lock time.

The presently disclosed systems, methods, and/or apparatuses optionally and separately provide an adjustable gas block that reduces felt recoil.

The presently disclosed systems, methods, and/or apparatuses optionally and separately provide an adjustable gas block that allows the gas system to be "tuned".

The presently disclosed systems, methods, and/or apparatuses optionally and separately provide an adjustable gas block that is capable of bleeding off extra gas pressure before it actuates the bolt carrier and causes excessive recoil.

The presently disclosed systems, methods, and/or apparatuses optionally and separately provide an adjustable gas block for short barrel rifles.

The presently disclosed systems, methods, and/or apparatuses optionally and separately provide an adjustable gas block that reduces felt recoil and provides balance to the gas system.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

For simplicity and clarification, the design factors and operating principles of the adjustable gas block according to the presently disclosed systems, methods, and/or apparatuses are explained with reference to various exemplary embodiments of an adjustable gas block according to the presently disclosed systems, methods, and/or apparatuses. The basic explanation of the design factors and operating principles of the adjustable gas block is applicable for the understanding, design, and operation of the adjustable gas block of the presently disclosed systems, methods, and/or apparatuses. It should be appreciated that the adjustable gas block can be adapted to many applications where excessive gas pressure or blowback is experienced within a firearm.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "AR-15", "firearm", and "gas block" are used for basic explanation and understanding of the operation of the systems, methods, and apparatuses of the present disclosure. Therefore, the terms "AR-15", "firearm", and "gas block" are not to be construed as limiting the systems, methods, and apparatuses of the present disclosure. Thus, the terms "AR-15" and "firearm" are to be understood to broadly include any firearm having a blowback operated system.

Figure 1:
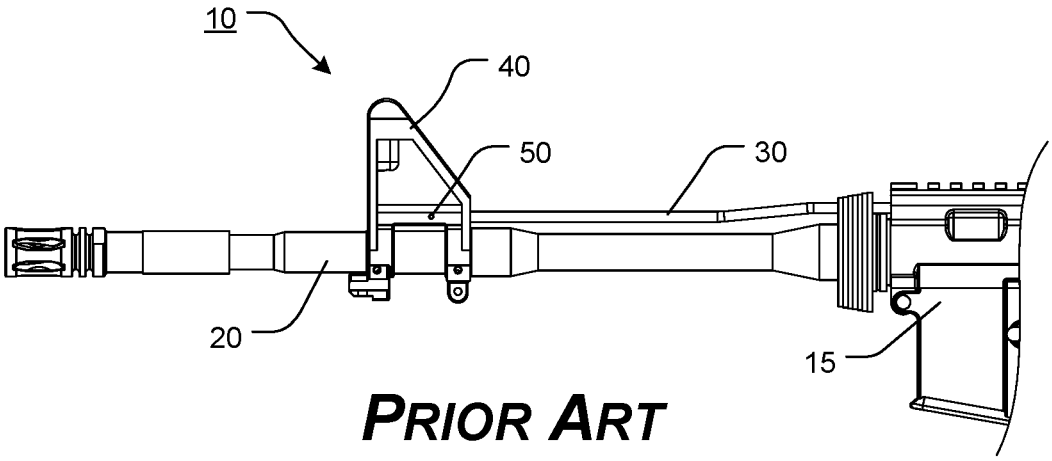
PRIOR ART FIG. 1
FIG. 1 illustrates a side view of a portion of a known AR-15 style barrel assembly, showing a known front sight (or gas block)
Figure 2:
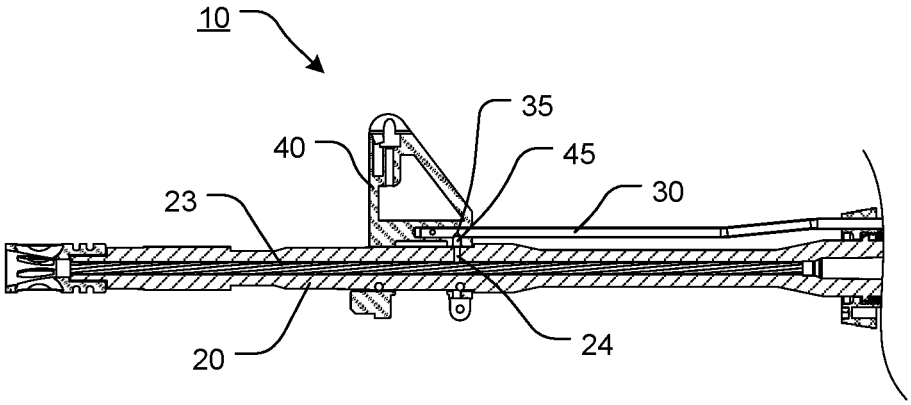
PRIOR ART FIG. 2
FIG. 2 illustrates a side cutaway view of a portion of a known AR-15 style barrel assembly, showing a known front sight (or gas block)
Figure 3:
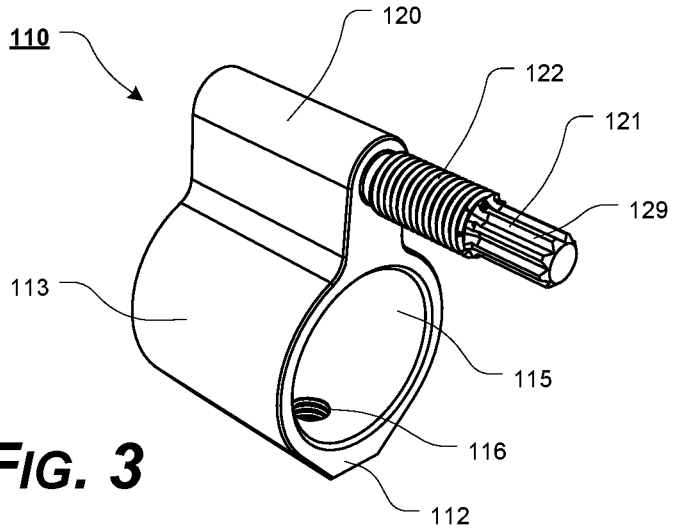
FIG. 3 illustrates an upper, front, perspective view of an exemplary embodiment of a gas block, according to the presently disclosed systems, methods, and/or apparatuses.
Figure 4:
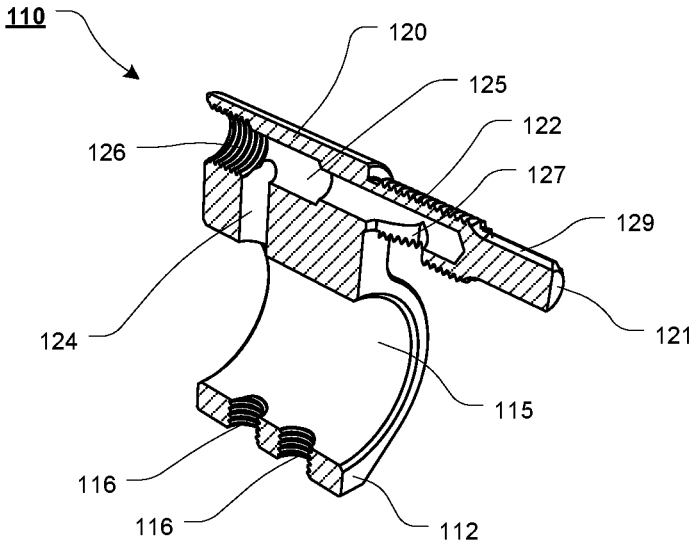
FIG. 4 illustrates an upper, front, perspective, cross-sectional view of an exemplary embodiment of a gas block, according to the presently disclosed systems, methods, and/or apparatuses.
Figure 5:
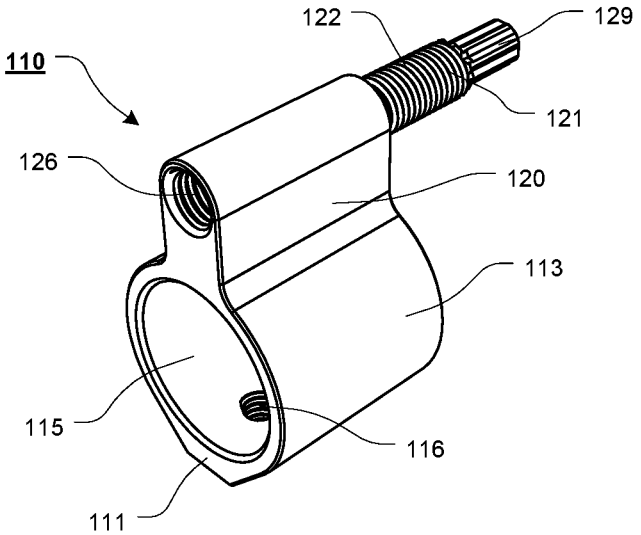
FIG. 5 illustrates an upper, rear, perspective view of an exemplary embodiment of a gas block, according to the presently disclosed systems, methods, and/or apparatuses.
Figure 6:
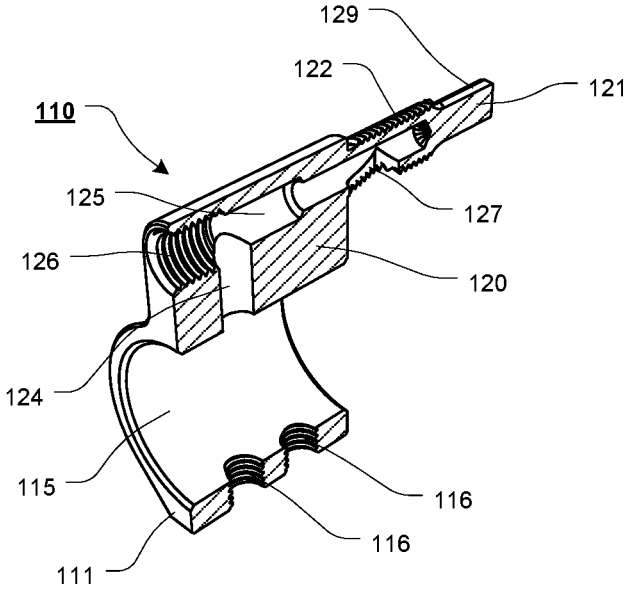
FIG. 6 illustrates an upper, rear, perspective, cross-sectional view of an exemplary embodiment of a gas block, according to the presently disclosed systems, methods, and/or apparatuses.
Figure 7:
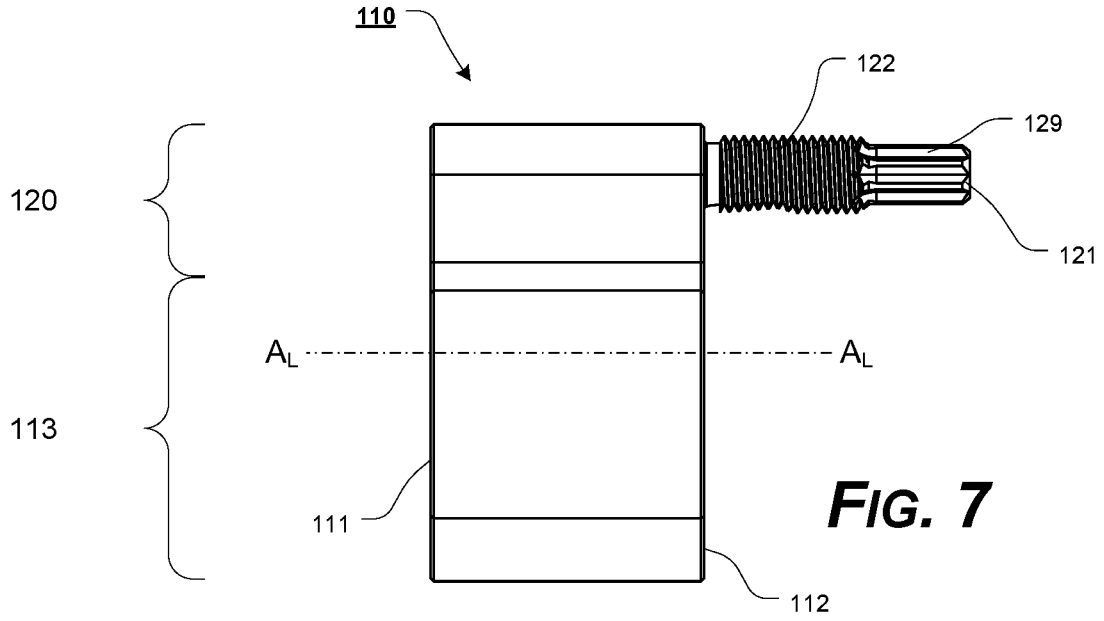
FIG. 7 illustrates a right side view of an exemplary embodiment of a gas block, according to the presently disclosed systems, methods, and/or apparatuses.
Figure 8:
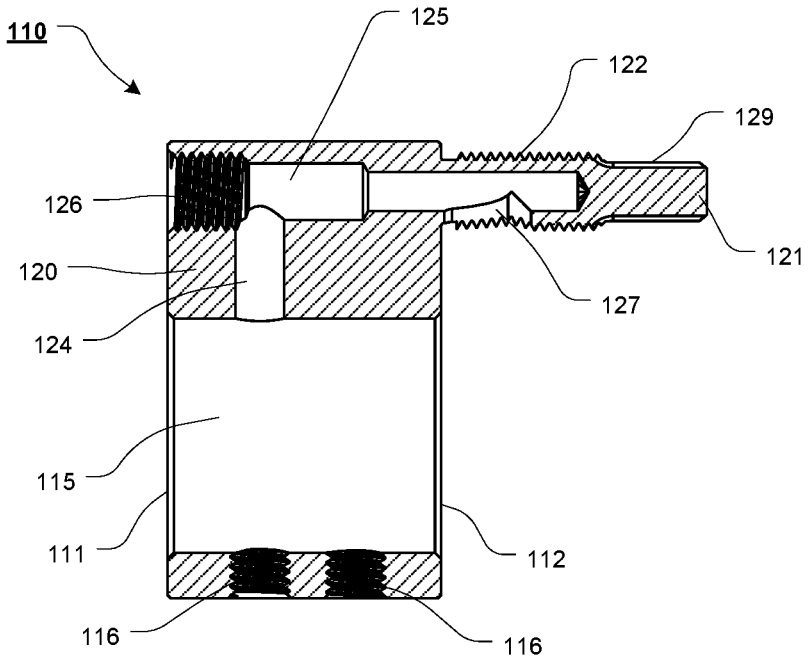
FIG. 8 illustrates a right side, cross-sectional view of an exemplary embodiment of a gas block, according to the presently disclosed systems, methods, and/or apparatuses.
Figure 9:
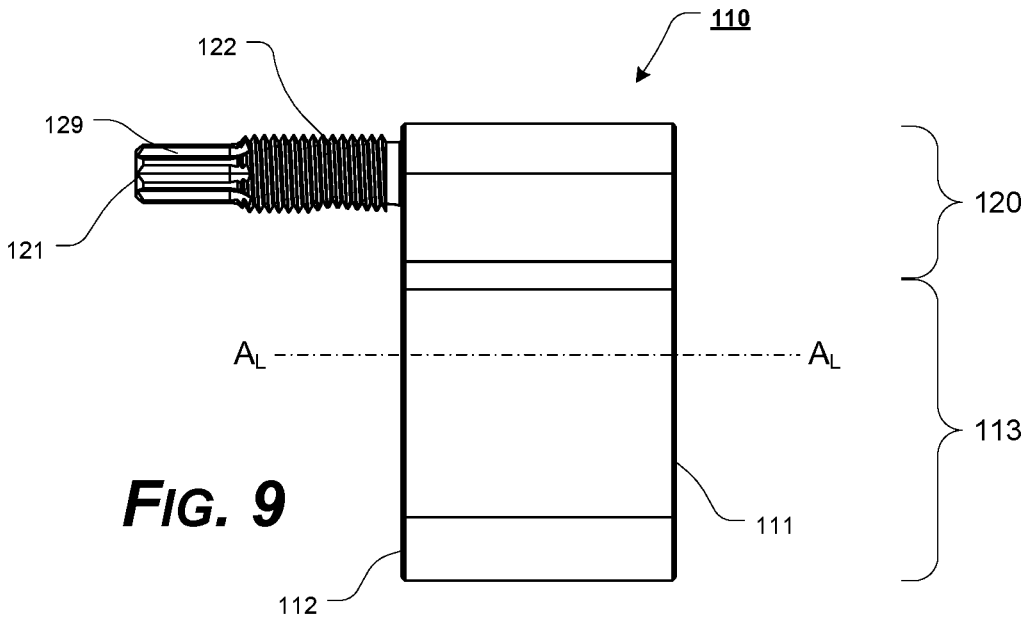
FIG. 9 illustrates a left side view of an exemplary embodiment of a gas block, according to the presently disclosed systems, methods, and/or apparatuses.
Figure 10:
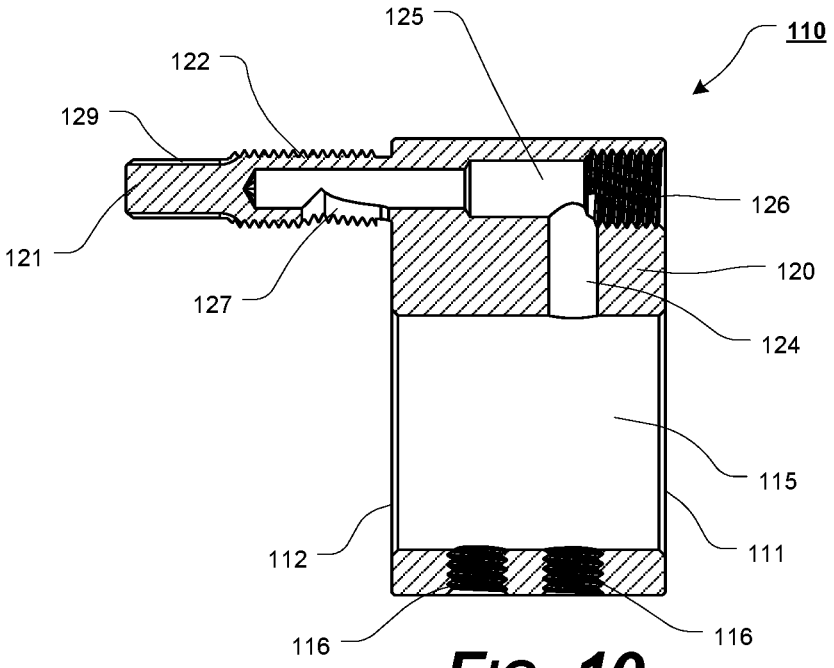
FIG. 10 illustrates a left side, cross-sectional view of an exemplary embodiment of a gas block, according to the presently disclosed systems, methods, and/or apparatuses.
Figure 11:
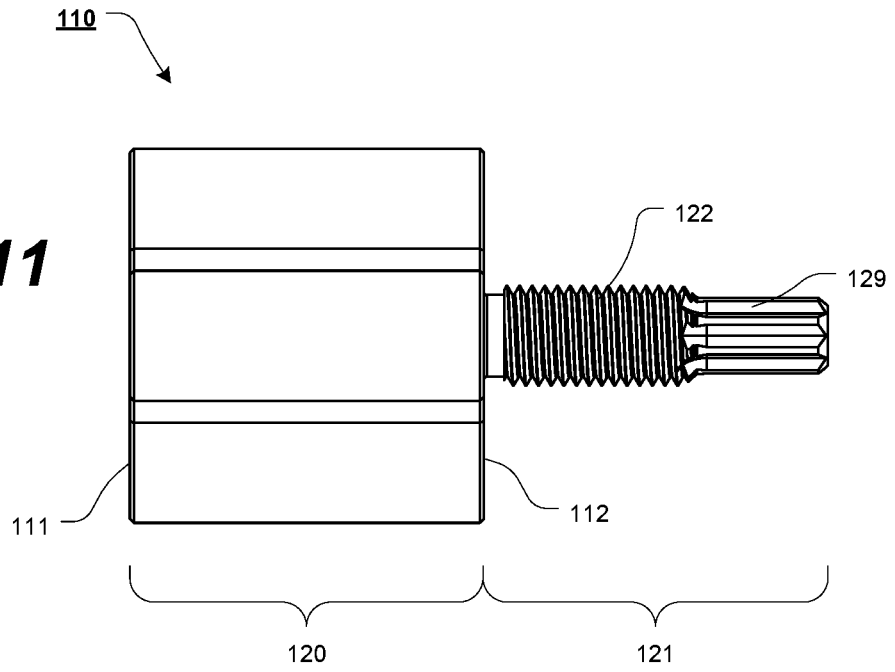
FIG. 11 illustrates a top view of an exemplary embodiment of a gas block, according to the presently disclosed systems, methods, and/or apparatuses.
Figure 12:
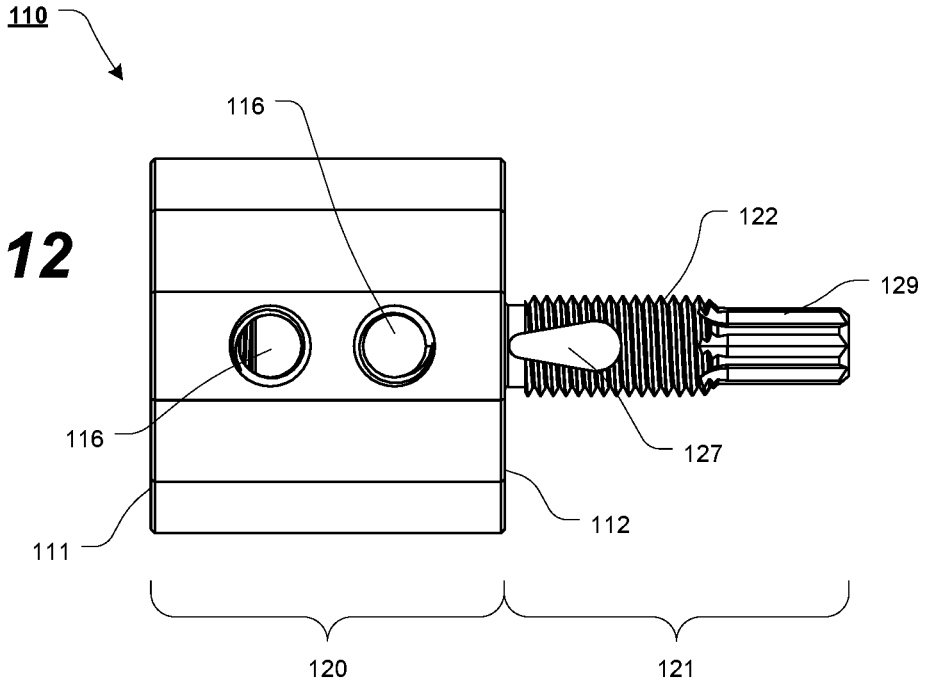
FIG. 12 illustrates a bottom view of an exemplary embodiment of a gas block, according to the presently disclosed systems, methods, and/or apparatuses.
Figure 13:
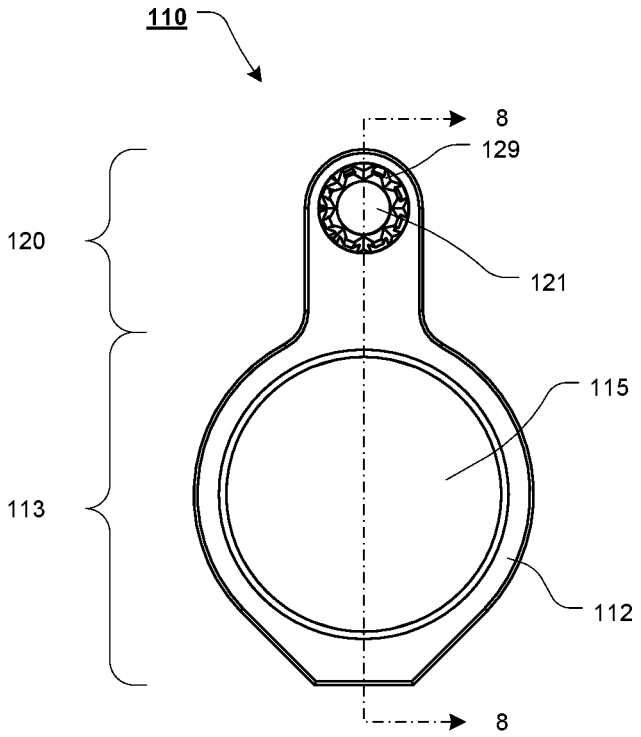
FIG. 13 illustrates a front view of an exemplary embodiment of a gas block, according to the presently disclosed systems, methods, and/or apparatuses.
Figure 14:
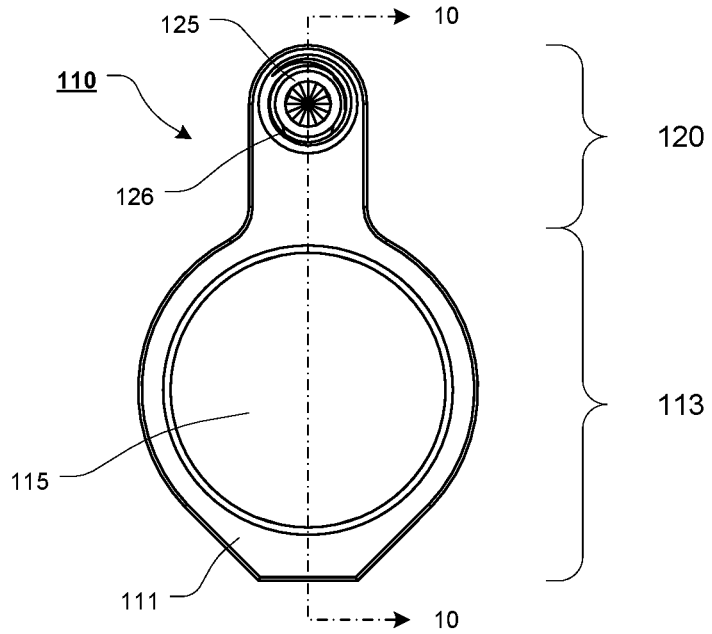
FIG. 14 illustrates a rear view of an exemplary embodiment of a gas block, according to the presently disclosed systems, methods, and/or apparatuses.
Figure 15:
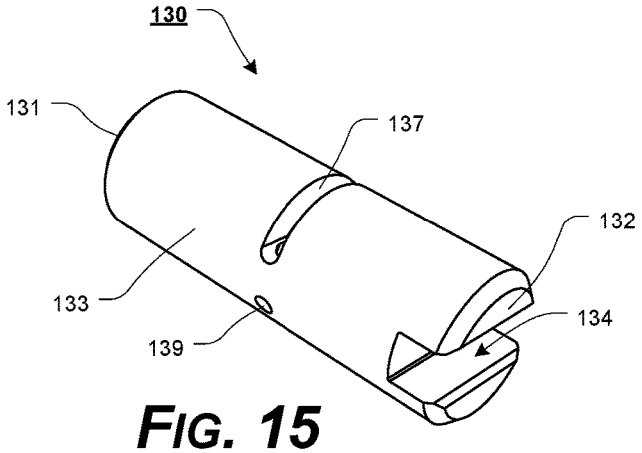
FIG. 15 illustrates an upper, front, perspective view of an exemplary embodiment of a vent cap, according to the presently disclosed systems, methods, and/or apparatuses.
Figure 16:
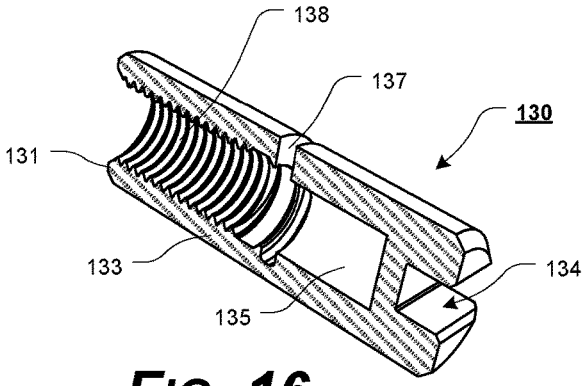
FIG. 16 illustrates an upper, front, perspective, cross-sectional view of an exemplary embodiment of a vent cap, according to the presently disclosed systems, methods, and/or apparatuses.
Figure 17:
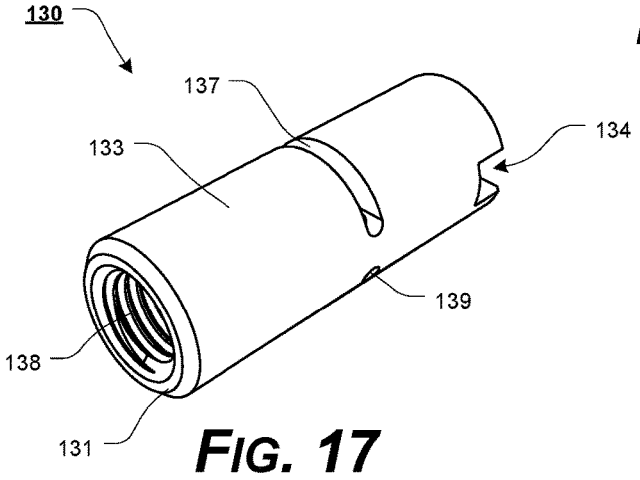
FIG. 17 illustrates an upper, rear, perspective view of an exemplary embodiment of a vent cap, according to the presently disclosed systems, methods, and/or apparatuses.
Figure 18:
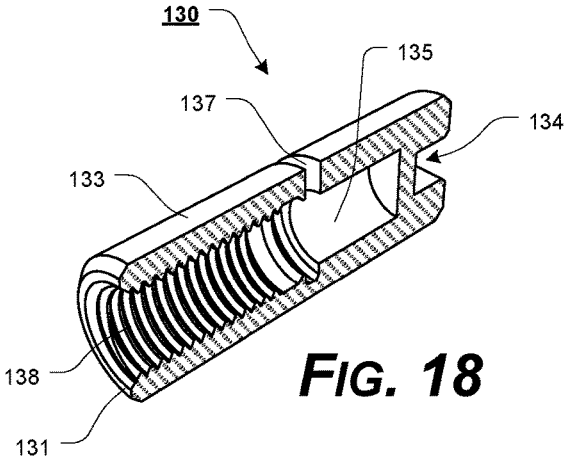
FIG. 18 illustrates an upper, rear, perspective, cross-sectional view of an exemplary embodiment of a vent cap, according to the presently disclosed systems, methods, and/or apparatuses.
Figure 19:
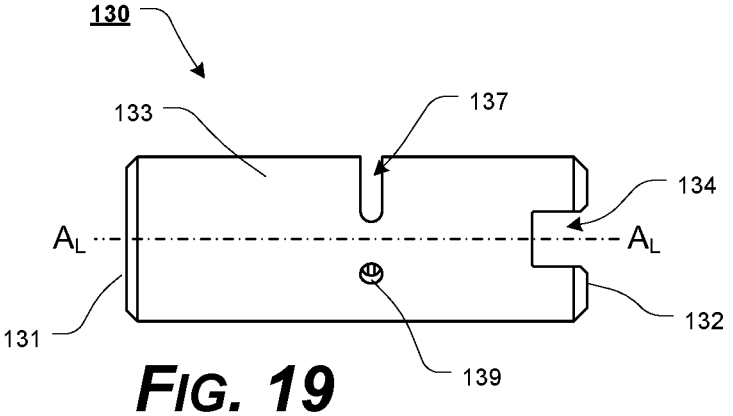
FIG. 19 illustrates a right side view of an exemplary embodiment of a vent cap, according to the presently disclosed systems, methods, and/or apparatuses.
Figure 20:
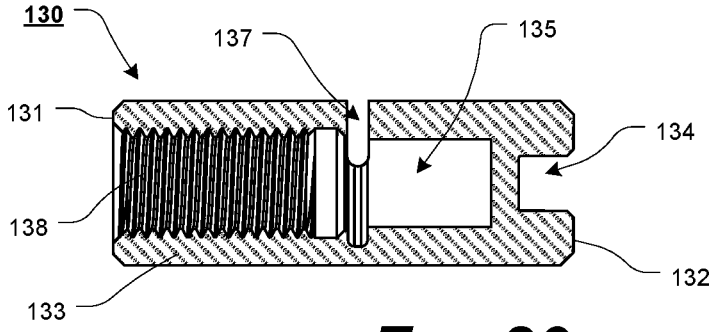
FIG. 20 illustrates a right side, cross-sectional view of an exemplary embodiment of a vent cap, according to the presently disclosed systems, methods, and/or apparatuses.
Figure 21:
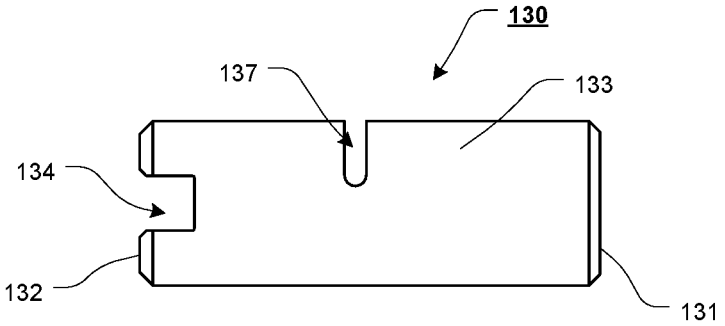
FIG. 21 illustrates a right side view of an exemplary embodiment of a vent cap, according to the presently disclosed systems, methods, and/or apparatuses.
Figure 22:
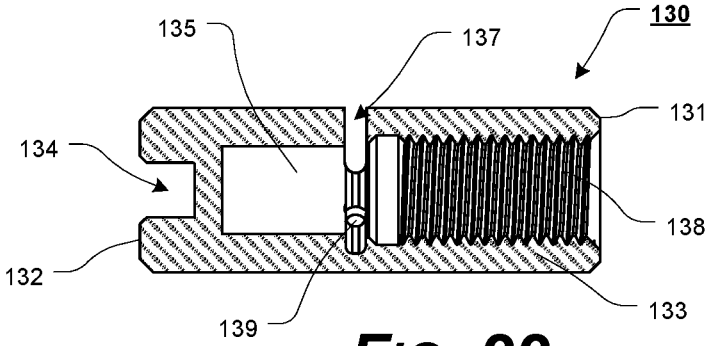
FIG. 22 illustrates a right side, cross-sectional view of an exemplary embodiment of a vent cap, according to the presently disclosed systems, methods, and/or apparatuses.
Figure 23:
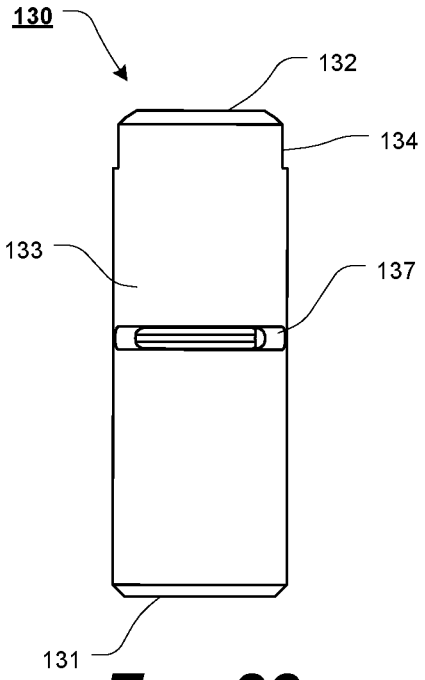
FIG. 23 illustrates a top view of an exemplary embodiment of a vent cap, according to the presently disclosed systems, methods, and/or apparatuses.
Figure 24:
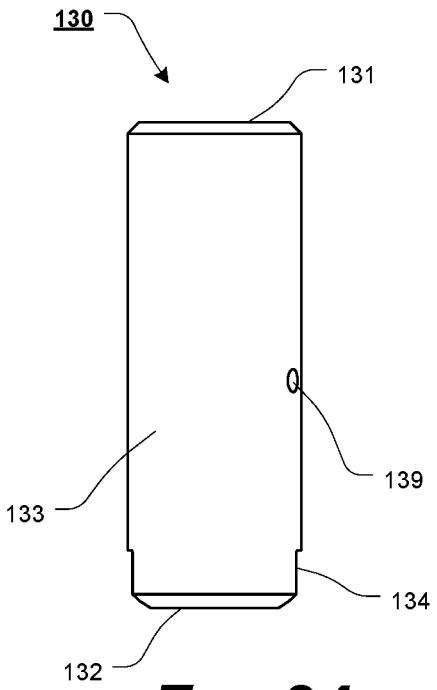
FIG. 24 illustrates a bottom view of an exemplary embodiment of a vent cap, according to the presently disclosed systems, methods, and/or apparatuses.
Figure 25:
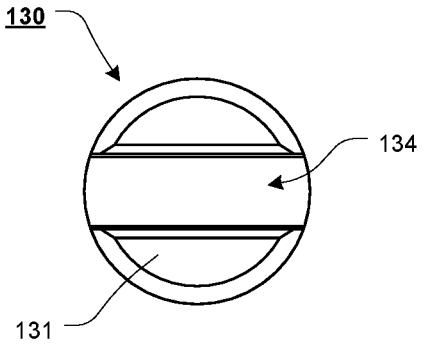
FIG. 25 illustrates a front view of an exemplary embodiment of a vent cap, according to the presently disclosed systems, methods, and/or apparatuses.
Figure 26:
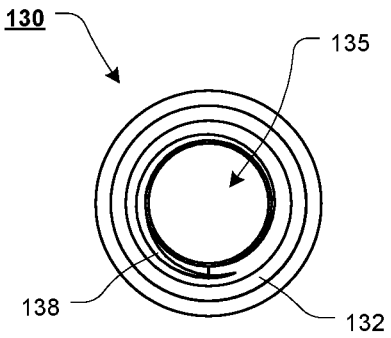
FIG. 26 illustrates a rear view of an exemplary embodiment of a vent cap, according to the presently disclosed systems, methods, and/or apparatuses.
Figure 27:
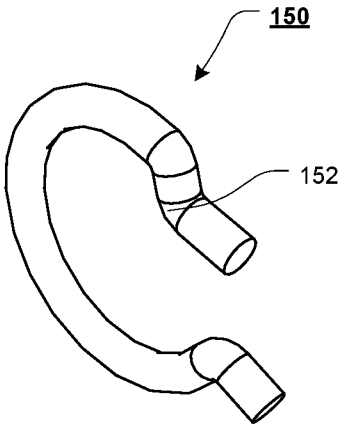
FIG. 27 illustrates a perspective view of an exemplary embodiment of a tension element, according to the presently disclosed systems, methods, and/or apparatuses.
Figure 28:
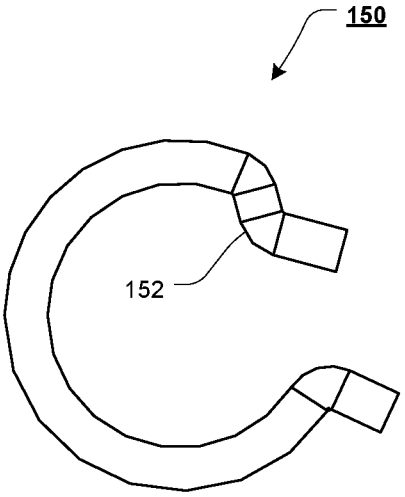
FIG. 28 illustrates a side view of an exemplary embodiment of a tension element, according to the presently disclosed systems, methods, and/or apparatuses.
Figure 29:
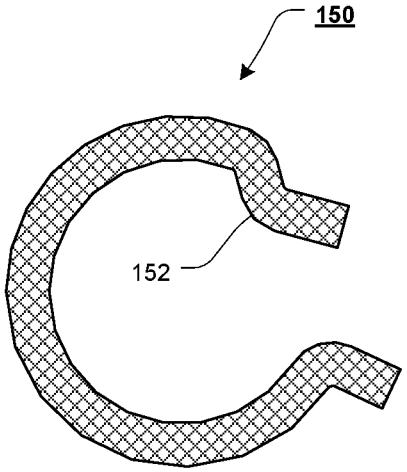
FIG. 29 illustrates a side, cross-sectional view of an exemplary embodiment of a tension element, according to the presently disclosed systems, methods, and/or apparatuses.
Figure 30:
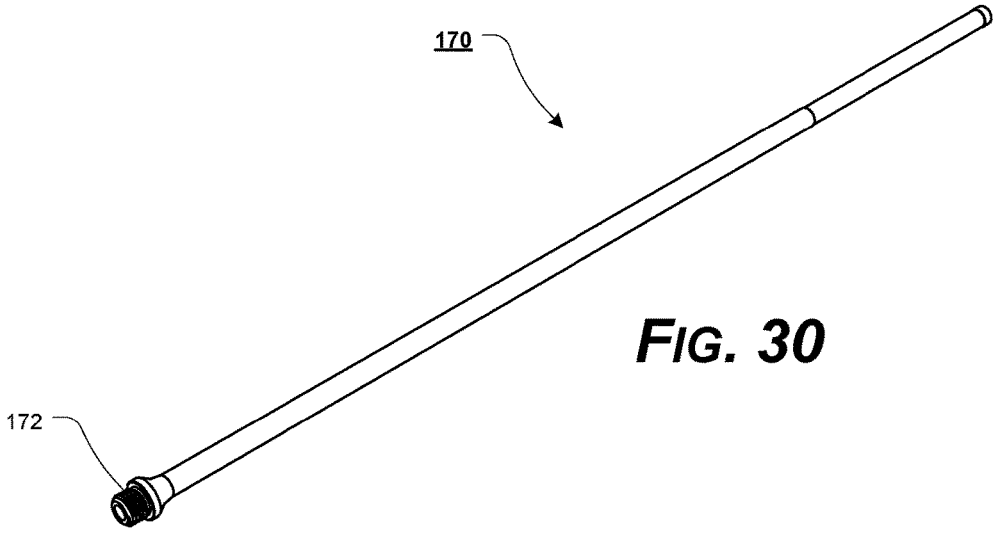
FIG. 30 illustrates a perspective view of an exemplary embodiment of a gas tube, according to the presently disclosed systems, methods, and/or apparatuses.
Figure 31:
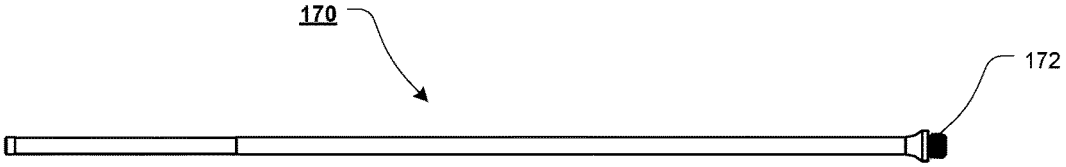
FIG. 31 illustrates a side view of an exemplary embodiment of a gas tube, according to the presently disclosed systems, methods, and/or apparatuses.
Figure 32:
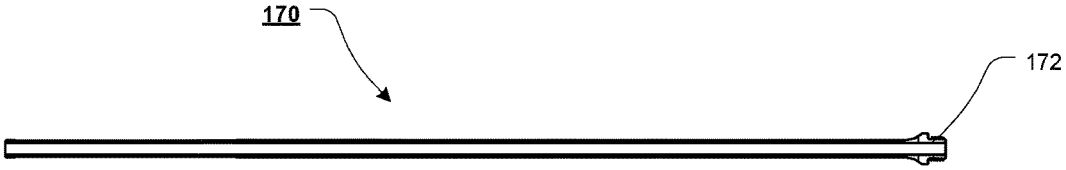
FIG. 32 illustrates a side, cross-sectional view of an exemplary embodiment of a gas tube, according to the presently disclosed systems, methods, and/or apparatuses.
Figure 33:
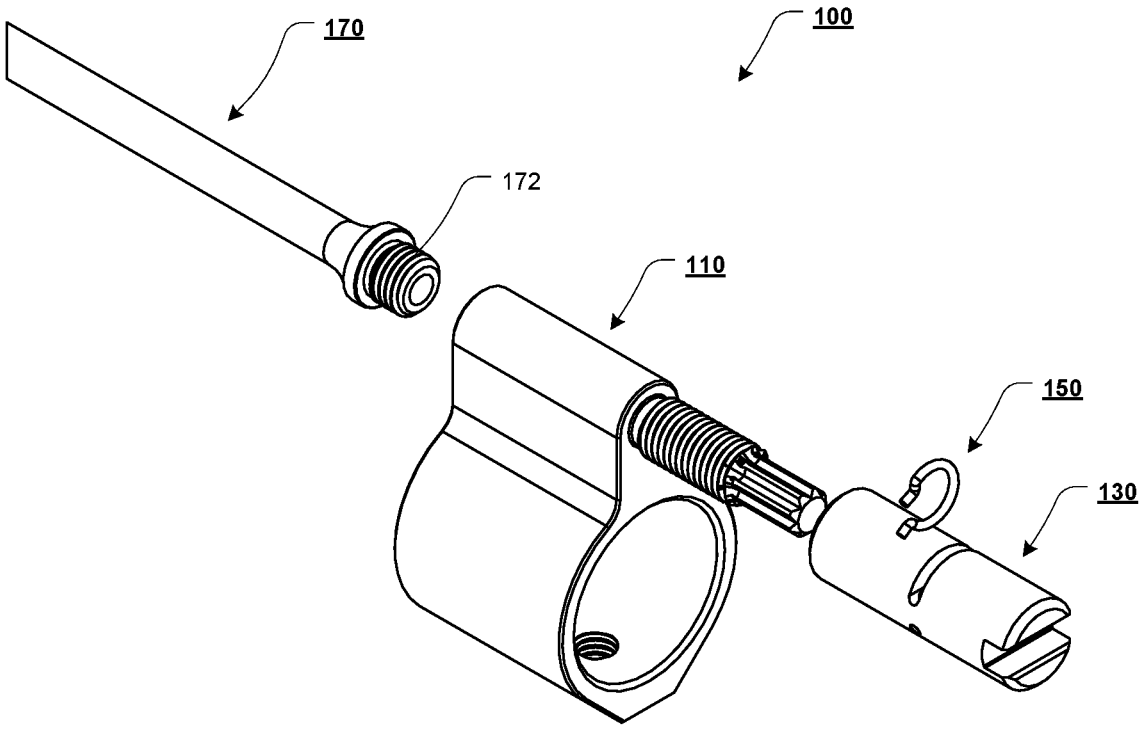
FIG. 33 illustrates an exploded view of certain exemplary components of an adjustable gas block, according to the presently disclosed systems, methods, and/or apparatuses.
Figure 34:
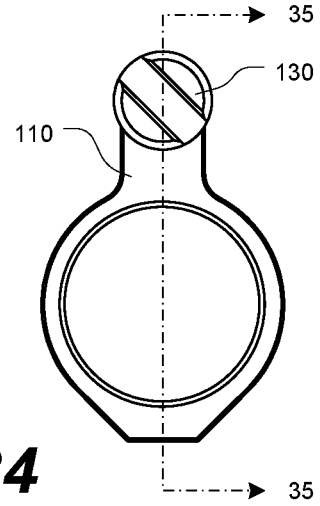
FIG. 34 illustrates a front view of certain exemplary components of an adjustable gas block, according to the presently disclosed systems, methods, and/or apparatuses.

Turning now to the drawing FIGS., FIGS. 1 and 2 illustrate certain elements and/or aspects of a known, exemplary AR-15 style barrel assembly 10, showing a known front sight gas block 40.

Generally, the barrel assembly 10 includes a barrel 20 extending from an upper receiver 15. The barrel 20 includes a bore 23 and a barrel gas port 24. A front sight gas block 40 is fitted to the barrel 20 such that a front sight gas port 45 is aligned with the barrel gas port 24 and a gas tube gas port 35, such that the bore 23 is in fluid communication (via barrel gas port 24, front sight gas port 45, and gas tube gas port 35) with the gas tube 30. The gas tube 30 is maintained in place relative to the front sight gas port 45, via a roll pin 50. In this manner, the barrel assembly 10 is able to operate, as described above.

It should be appreciated that a more detailed explanation of the components of the barrel assembly 10, instructions regarding how to attach and use the various components of the barrel assembly 10, methods for installing the related components of the barrel assembly 10, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the systems, methods, and/or apparatuses as described.

FIGS. 3-39 illustrate certain elements and/or aspects of various exemplary embodiments of an adjustable gas block assembly 100, according to this invention. In certain illustrative, non-limiting embodiments of the present disclosure, as illustrated in FIGS. 3-39, the adjustable gas block assembly 100 comprises at least some of a gas block 110 having a body portion 113, a gas block portion 120, a vent cap 130, and a tension element 150.

As illustrated, the gas block 110 extends, substantially parallel to a longitudinal axis $A_L$, from a first end 111 to a second end 112 and includes the body portion 113 and the gas block portion 120. A barrel borehole 115 extends through the body portion 113, along the longitudinal axis $A_L$. The barrel borehole 115 is adapted to receive at least a portion of a barrel 20 therethrough. In various exemplary embodiments, the barrel borehole 115 is adapted to receive a portion of a barrel 20 having an outer diameter of approximately 0.075 inches. Alternatively, the barrel borehole 115 may be adapted to receive a portion of a barrel 20 having an outer diameter of approximately 0.080 inches. It should be appreciated that the barrel borehole 115 may be adapted to receive a portion of a barrel 20 having any desired outer diameter.

The gas block portion 120 extends from the body portion 113 and includes a gas block gas port 124 and a gas tube borehole 125. A gas block extension portion 121 extends from an upper portion of the gas block portion 120.

In various exemplary, nonlimiting embodiments, at least a portion of the gas block extension portion 121 extends beyond at least a portion of the gas block portion 120 and the body portion 113. At least a portion of the gas block extension portion 121 includes an externally threaded portion 122 and a spline portion 129. In certain exemplary embodiments, the externally threaded portion 122 is located proximate the gas block portion 120, while the spline portion 129 is located distal from the gas block portion 120, along the gas block extension portion 121. However, in certain alternative embodiments, the spline portion 129 may be located proximate the gas block portion 120, while the externally threaded portion 122 may be located distal from the gas block portion 120.

The spline portion 129 includes at least one and optionally a plurality of splines extending radially from the spline portion 129 at spaced apart locations. Each spline is separated from each other spline by a groove or recess formed in the spline portion 129.

The gas tube borehole 125 extends from the first end 111 of the gas block portion 120, through the gas block portion 120, and into at least a portion of the gas block extension portion 121. In various exemplary embodiments, the gas tube borehole 125 extends along the longitudinal axis $A_L$ of the gas block extension portion 121, parallel to the barrel borehole 115.

At least one vent aperture 127 is formed in a portion of the externally threaded portion 122 of the gas block extension portion 121. The at least one vent aperture 127 is disposed along at least a portion of the gas block extension portion 121. In various exemplary embodiments, the at least one vent aperture 127 is disposed along at least a portion of the externally threaded portion 122, between the gas block portion 120 and the spline portion 129. The at least one vent aperture 127 extends through the gas block extension portion 121 and into the gas tube borehole 125, such that the vent aperture 127 allows fluid communication between the gas tube borehole 125 and an exterior of the gas block extension portion 121 and the gas block 110.

In certain exemplary embodiments, the at least one vent aperture 127 comprises a substantially elongate, constant width slot or aperture. However, it should be appreciated that the number, size, and shape of the at least one vent aperture 127 is a design choice based upon the desired functionality of the at least one vent aperture 127 (i.e., the amount of propellant gas that the at least one vent aperture 127 is designed to expel in a given area).

Thus, as illustrated, the at least one vent aperture 127 may comprise an expanding (or contracting) width slot or aperture. Alternatively, the at least one vent aperture 127 may comprise a substantially ovular, rectangular, or other shaped aperture or a plurality of apertures formed in a desired pattern through the gas block extension portion 121.

It should be further understood that if more than one vent aperture 127 is provided, the size and shape of each one vent aperture 127 may be the same or may vary. Thus, a plurality of vent apertures 127 of varying sizes and shapes may be formed through the gas block extension portion 121, at any desired spaced apart location or in any desired linear or other formation.

At least a portion of the gas tube borehole 125, extending from the first end 111 of the gas block portion 120 includes an internally threaded portion 126. The gas tube borehole 125 is adapted to receive at least a portion of a gas tube 170 therein. At least a portion of the gas tube 170 includes an externally threaded portion 172. The internally threaded portion 126 and the externally threaded portion 172 include corresponding, mateable threads, such that the gas tube 170 is able to be at least partially threadedly attached or coupled to the gas tube borehole 125, via interaction of the externally threaded portion 172 of the gas tube 170 and the internally threaded portion 126 of the gas tube borehole 125.

In certain exemplary, nonlimiting embodiments, the internally threaded portion 126 of the gas tube borehole 125 is not included. In these optional, exemplary embodiments, a standard gas tube (such as, for example, gas tube 30) may be utilized in conjunction with the gas block 110. In these exemplary embodiments, a roll pin aperture may be included to allow a gas tube to be further secured to the gas block 110.

A gas block gas port 124 is disposed between the barrel borehole 115 and the gas tube borehole 125, such that the barrel borehole 115 is in fluid communication with the gas tube borehole 125, via the gas block gas port 124. The gas block gas port 124 is formed such that, when the adjustable gas block assembly 100 is properly secured to a barrel 20 and the gas tube 170 is properly secured within the gas tube borehole 125, as illustrated, for example, in FIGS. 35, 38, and 39, the barrel gas port 24 is aligned with and in fluid communication with the gas block gas port 124 such that the bore 23 is in fluid communication (via the barrel gas port 24, the gas block gas port 124, and the gas tube borehole 125) with the gas tube 170.

Once appropriately positioned around the barrel 20, the adjustable gas block assembly 100 may optionally be held in place by a frictional fit between the inner surface of the barrel borehole 115 and the outer surface of the barrel 20. Alternatively, the adjustable gas block assembly 100 may optionally include one or more setscrew aperture 116 formed through the body portion 113, perpendicular to the barrel borehole 115. The inclusion of the one or more setscrew aperture 116 allows the adjustable gas block assembly 100 to be further secured to the barrel 20 via one or more setscrews 119.

In various exemplary, nonlimiting embodiments, the adjustable gas block assembly 100 may be pinned to the barrel 20, in a manner similar to how a known front sight 40 is pinned to the barrel 20.

In various exemplary, nonlimiting embodiments, the vent cap 130 comprises an elongate portion of material extending, substantially parallel to a longitudinal axis $A_L$, from a first vent cap end 131 to a second vent cap end 132.

The vent cap 130 includes a vent cap cavity 135 that extends from the at least partially open first vent cap end 131, into the interior of the vent cap body 133, along the longitudinal axis $A_L$, toward the second vent cap end 132. The vent cap cavity 135 includes an internally threaded portion 138 that extends from the first vent cap end 131.

The internally threaded portion 138 of the vent cap cavity 135 includes threads that correspond to the externally threaded portion 122 of the gas block extension portion 121. Thus, as illustrated most clearly in FIGS. 35, 38, 39, the vent cap 130 may be threadedly attached to the gas block extension portion 121, via interaction of the externally threaded portion 122 of the gas block extension portion 121 and the internally threaded portion 138 of the vent cap cavity 135.

One or more slots 137 and/or apertures 139 are formed in or along the vent cap body 133 of the vent cap 130. In various exemplary embodiments, each slot 137 and/or aperture 139 extends through the vent cap body 133 and into the vent cap cavity 135. The slot 137 and/or aperture 139 is formed so as to allow a portion of a tension element 150 to be secured about at least a portion of the vent cap 130. In various exemplary embodiments, the tension element 150 may optionally comprise a pawl spring, a c-clip, a wire lock, a circlip, or the like.

Figure 35:
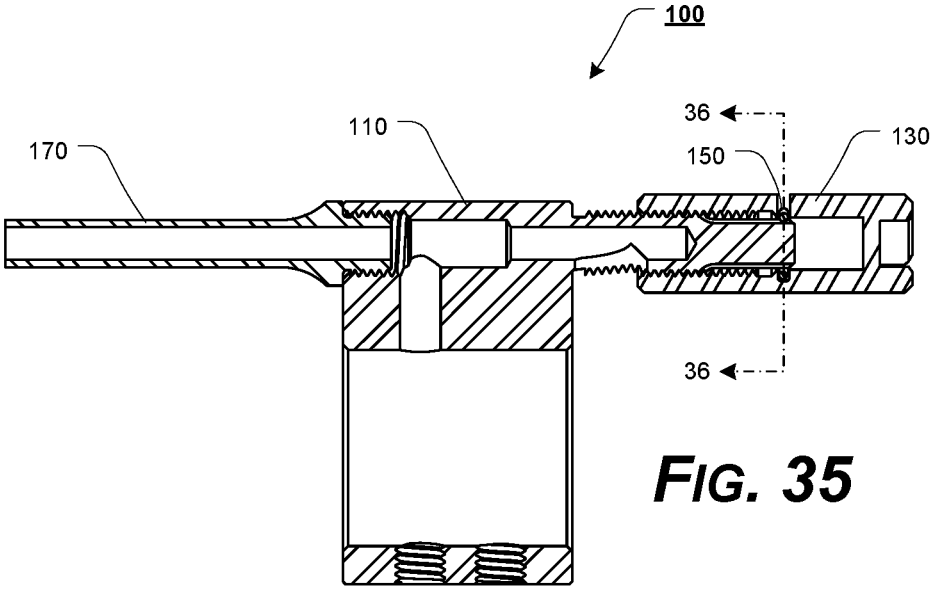
FIG. 35 illustrates a side, cross-sectional view, taken along line 35-35 of FIG. 34, of certain exemplary components of an adjustable gas block, wherein the vent cap is in a substantially open position, according to the presently disclosed systems, methods, and/or apparatuses.
Figure 36:
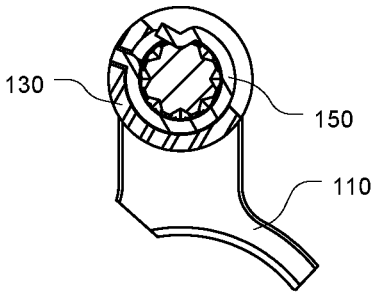
FIG. 36 illustrates a side, cross-sectional view, taken along line 36-36 of FIG. 35, of certain exemplary components of an adjustable gas block, according to the presently disclosed systems, methods, and/or apparatuses.
Figure 37:
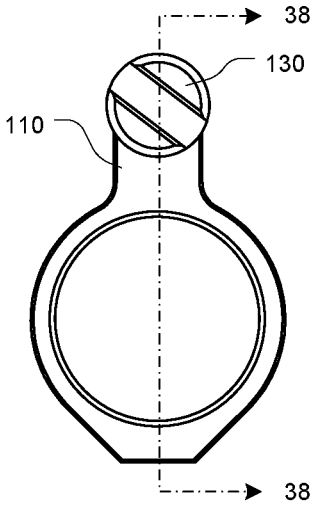
FIG. 37 illustrates a front view of certain exemplary components of an adjustable gas block, according to the presently disclosed systems, methods, and/or apparatuses.
Figure 38:
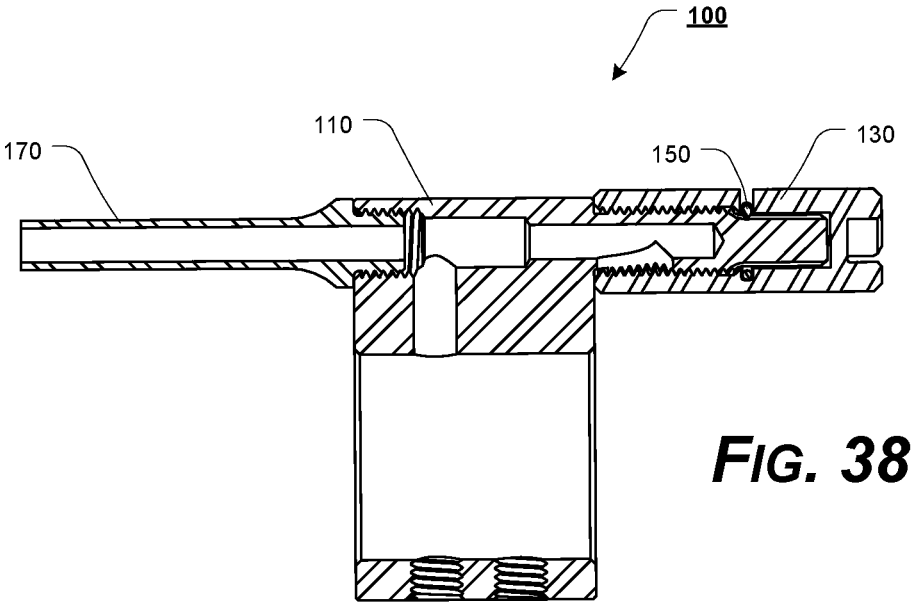
FIG. 38 illustrates a side, cross-sectional view, taken along line 38-38 of FIG. 37, of certain exemplary components of an adjustable gas block, wherein the vent cap is in a closed position, according to the presently disclosed systems, methods, and/or apparatuses.
Figure 39:
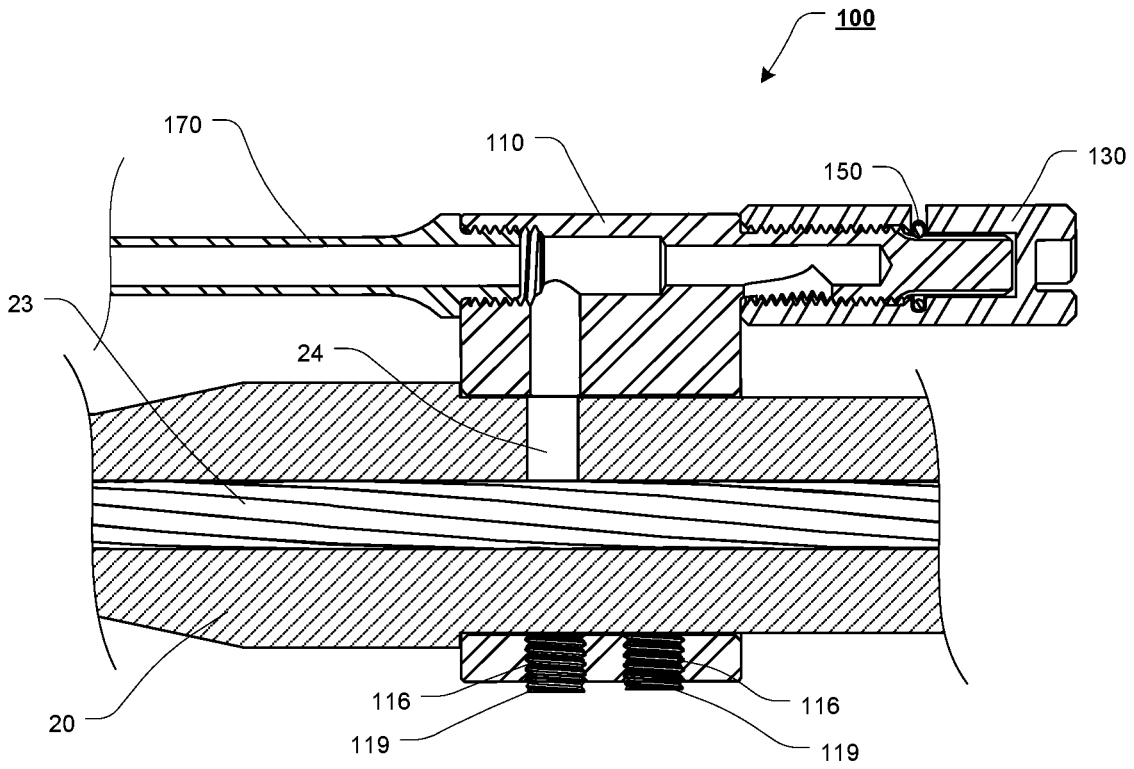
FIG. 39 illustrates a side, cross-sectional view of an exemplary embodiment of an adjustable gas block attached or coupled to a firearm barrel, according to the presently disclosed systems, methods, and/or apparatuses.

At least a pawl 152 of the tension element 150 extends through the slot 137 and into the vent cavity 135. As illustrated most clearly in FIGS. 35, 38, 39, when the tension element 150 is snap fitted or secured about at least a portion of the vent cap 130, the pawl 152 of the tension element 150 extends through the slot 137 and into the vent cavity 135. As the vent cap 130 is threaded the attached or coupled to the gas block extension portion 121, the pawl 152 interacts with the splines of the spine portion 129. As the vent cap 130 is rotated, for example in a clockwise fashion if the externally threaded portion 122 and the internally threaded portion 138 include right-hand threads, the vent cap 130 can be moved from an open position, as illustrated in FIG. 35, toward a closed position, as illustrated in FIGS. 38 and 39. The vent cap 130 can then be rotated, for example in a counterclockwise fashion if the externally threaded portion 122 and the internally threaded portion 138 include right-hand threads, such that the vent cap 130 can be moved toward the open position. As the vent cap 130 is rotated, the spring bias of the tension element 150 is overcome such that the pawl 152 can be urged from a recess between adjacent splines of the spine portion 129, to ride along the top portion of the spine, and then be urged back to a recess between adjacent splines. In this manner, the spring tension from the tension element 150, provided by the pawl 152, helps to secure the vent cap 130 at a desired position along the gas block extension portion 121.

In various exemplary embodiments, a vent cap recess 134 may optionally be formed in the second vent cap end 132 to allow for the engagement of a tool to assist in rotation of the vent cap 130. It should be appreciated that the vent cap recess 134 may take any desired shape or form to allow a tool, key, or other device to be used to assist in rotation of the vent cap 130.

As the vent cap 130 is rotated to the closed position, the vent cap 130 is fully seated along the gas block extension portion 121 and the vent cap body 133 is positioned over the vent aperture 127, such that the vent aperture 127 is fully obstructed, blocked, or occluded by the vent cap 130, so as to inhibit or restrict the flow of fluid from the gas tube borehole 125 through the vent aperture 127. As the vent cap 130 is rotated toward the open position, along the gas block extension portion 121, a lessening amount of the vent aperture 127 is obstructed, blocked, or occluded by the vent cap 130, so as to allow an amount of fluid (i.e., propellant gases) from the gas tube borehole 125, through the vent aperture 127.

Thus, by rotating the vent cap 130 relative to the gas block extension portion 121, the position of the vent cap 130, along the gas block extension portion 121 and relative to the vent aperture 127.

The tension element 150 is utilized in conjunction with the vent cap 130 and the spline portion 129 to maintain a desired degree of pressure against the spline portion 129, to maintain a desired relative rotational position of the vent cap 130 relative to the gas block extension portion 121. Thus, the degree or amount to which the vent cap 130 obstructs, blocks, or occludes the vent aperture 127 can be adjusted. In this manner, the amount of fluid (i.e., propellant gases) from the gas tube borehole 125 that escape through the vent aperture 127 (if at all) can be adjusted, based upon a user's desire.

In various exemplary embodiments, various components of the adjustable gas block assembly 100 are substantially rigid and are formed of steel. Alternate materials of construction of the various components of the adjustable gas block assembly 100 may include one or more of the following: titanium, aluminum, stainless steel, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the adjustable gas block assembly 100 is a design choice based on the desired appearance and functionality of the adjustable gas block assembly 100.

It should be appreciated that certain elements of the adjustable gas block assembly 100 may be formed as an integral unit (such as, for example, the gas block portion 120 and the gas block extension portion 121). Alternatively, suitable materials can be used and sections or elements made independently and attached or coupled together, such as by adhesives, welding, screws, rivets, pins, or other fasteners, to form the various elements of the adjustable gas block assembly 100.

It should also be understood that the overall size and shape of the adjustable gas block assembly 100 and the various portions thereof is a design choice based upon the desired functionality and/or appearance of the adjustable gas block assembly 100.

During assembly and use, the gas tube 170 is optionally threadedly or otherwise attached or coupled to the gas block 110, via interaction of the externally threaded portion 172 of the gas tube 170 and the internally threaded portion 126 of the gas tube borehole 125. When the gas block 110 is attached or coupled to the barrel 20 and the gas tube 170 is attached or coupled to the gas block 110, the barrel gas port 24 is aligned with and in fluid communication with the gas block gas port 124 such that the bore 23 is in fluid communication (via the barrel gas port 24, the gas block gas port 124, and the gas tube borehole 125) with the gas tube 170.

The vent cap 130 is threadedly attached or coupled to the gas block 110, via interaction of the externally threaded portion 122 of the gas block extension portion 121 and the internally threaded portion 138 of the vent cap 130. Thus, when the gas block 110 is attached or coupled to the barrel 20, the gas tube 170 is threadedly attached or coupled to the gas block 110, and the vent cap 130 is threaded the attached to the gas block extension portion 121, the barrel gas port 24 is aligned with and in fluid communication with the gas block gas port 124 such that the bore 23 is in fluid communication (via the barrel gas port 24, the gas block gas port 124, and the gas tube borehole 125) with the gas tube 170 and the vent aperture 127.

The rotational position of the vent cap 130, relative to the gas block extension portion 121 can be adjusted such that the amount of propellant gases from the gas block gas port 124 can be appropriately regulated. In this manner, the amount of propellant gases that flow through the gas tube 170 and the vent aperture 127 can be regulated.

Once installed, during the firing cycle, propellant gases flow through the bore 23 and a portion of the propellant gases flow through the barrel gas port 24, the gas block gas port 124, and the gas tube borehole 125. Once in the gas tube borehole 125, a portion of the propellant gases are returned via the gas tube 170 and, depending upon the rotational position of the vent cap 130, a portion of the gases may flow through the vent aperture 127.

Thus, the adjustable gas block assembly 100 of the present disclosure allows a user to determine the amount of propellant gas returned to the firearm, via the gas tube 170.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An adjustable gas block assembly, comprising:

a gas block having a body portion extending along a longitudinal axis;

a barrel borehole extending through said body portion, along said longitudinal axis, wherein said barrel borehole is adapted to receive at least a portion of a barrel therethrough;

a gas block extension portion extending from said body portion;

a gas tube borehole extending through a gas block portion and into at least a portion of said gas block extension portion;

a gas block gas port in fluid communication between said barrel borehole and said gas tube borehole;

a vent aperture extending through at least a portion of said gas tube borehole, wherein said vent aperture provides fluid communication between said gas tube borehole and an exterior of said gas block extension portion; and a vent cap positioned relative to said gas block extension portion, wherein said vent cap is rotatably positioned relative to said gas block extension portion so as to be rotated between a closed position, wherein said vent cap obstructs, blocks, or occludes said vent aperture, and an open position, wherein said vent cap does not obscure, block, or occlude said vent aperture, and wherein said vent cap is spring biased relative to said gas block extension portion by interaction of a portion of a tension element and a spline portion of said gas block extension portion.

2. The adjustable gas block assembly of claim 1, wherein said vent cap is spring biased relative to said gas block extension portion.

3. The adjustable gas block assembly of claim 1, wherein at least a portion of said gas tube borehole includes an internally threaded portion and wherein at least a portion of said gas tube includes an externally threaded portion, such that said gas tube is able to be at least partially threadedly attached or coupled to said gas tube borehole, via interaction of said externally threaded portion of said gas tube and said internally threaded portion of said gas tube borehole.

4. The adjustable gas block assembly of claim 1, wherein said vent aperture comprises a substantially elongate, constant width slot.

5. The adjustable gas block assembly of claim 1, wherein said vent aperture comprises a plurality of apertures.

6. The adjustable gas block assembly of claim 1, wherein if said vent cap is positioned between said closed position and said open position, said vent cap partially obstructs, blocks, or occludes said vent aperture.

7. An adjustable gas block assembly, comprising:

a gas block having a body portion;

a barrel borehole extending through said body portion;

a gas block extension portion extending from said body portion;

a gas tube borehole extending through a gas block portion and into at least a portion of said gas block extension portion;

a gas block gas port in fluid communication between said barrel borehole and said gas tube borehole;

a vent aperture extending through at least a portion of said gas tube borehole, wherein said vent aperture provides fluid communication between said gas tube borehole and an exterior of said gas block extension portion; and a vent cap positioned relative to said gas block extension portion, wherein said vent cap is rotatably positioned relative to said gas block extension portion so as to be rotated between a closed position, wherein said vent cap obstructs, blocks, or occludes said vent aperture, and an open position, wherein said vent cap does not obscure, block, or occlude said vent aperture, and wherein said vent cap is spring biased relative to said gas block extension portion by interaction of a portion of a tension element and a spline portion of said gas block extension portion.

8. The adjustable gas block assembly of claim 7, wherein said vent cap is spring biased relative to said gas block extension portion.

9. The adjustable gas block assembly of claim 7, wherein at least a portion of said gas tube borehole includes an internally threaded portion and wherein at least a portion of said gas tube includes an externally threaded portion, such that said gas tube is able to be at least partially threadedly attached or coupled to said gas tube borehole, via interaction of said externally threaded portion of said gas tube and said internally threaded portion of said gas tube borehole.

10. The adjustable gas block assembly of claim 7, wherein said vent aperture comprises a substantially elongate, constant width slot.

11. The adjustable gas block assembly of claim 7, wherein said vent aperture comprises a plurality of apertures.

12. The adjustable gas block assembly of claim 7, wherein if said vent cap is positioned between said closed position and said open position, said vent cap partially obstructs, blocks, or occludes said vent aperture.

13. An adjustable gas block assembly, comprising:

a gas block;

a barrel borehole extending through said gas block;

a gas block extension portion extending from said gas block;

a gas tube borehole extending through a gas block portion and into at least a portion of said gas block extension portion;

a gas block gas port in fluid communication between said barrel borehole and said gas tube borehole;

a vent aperture extending through at least a portion of said gas tube borehole, wherein said vent aperture provides fluid communication between said gas tube borehole and an exterior of said gas block extension portion; and a vent cap positioned relative to said gas block extension portion, wherein said vent cap is rotatably positioned relative to said gas block extension portion so as to be rotated between an open position, wherein said vent cap does not obscure, block, or occlude said vent aperture and a closed position, wherein said vent cap obstructs, blocks, or occludes said vent aperture, and wherein at least a portion of said gas tube borehole includes an internally threaded portion and wherein at least a portion of said gas tube includes an externally threaded portion, such that said gas tube is able to be at least partially threadedly attached or coupled to said gas tube borehole, via interaction of said externally threaded portion of said gas tube and said internally threaded portion of said gas tube borehole.

14. The adjustable gas block assembly of claim 13, wherein said vent cap is spring biased relative to said gas block extension portion.

15. The adjustable gas block assembly of claim 13, wherein said vent aperture comprises a substantially elongate, constant width slot.

16. The adjustable gas block assembly of claim 13, wherein said vent aperture comprises a plurality of apertures.

17. The adjustable gas block assembly of claim 13, wherein if said vent cap is positioned between said closed position and said open position, said vent cap partially obstructs, blocks, or occludes said vent aperture.

* * * * *